US010856597B2

(12) United States Patent
Lewis

(10) Patent No.: US 10,856,597 B2
(45) Date of Patent: Dec. 8, 2020

(54) DEVICE FOR COMFORTABLY MAINTAINING OFF-SHOULDER FASHIONS

(71) Applicant: Shoulder Bare Ltd., Aurora, IL (US)

(72) Inventor: Symone Lewis, Aurora, IL (US)

(73) Assignee: Shoulder Bare Ltd., Aurora, IL (US)

( * ) Notice: Subject to any disclaimer, the term of this patent is extended or adjusted under 35 U.S.C. 154(b) by 120 days.

(21) Appl. No.: 16/293,315

(22) Filed: Mar. 5, 2019

(65) Prior Publication Data

US 2019/0289941 A1 Sep. 26, 2019

Related U.S. Application Data

(60) Provisional application No. 62/787,902, filed on Jan. 3, 2019, provisional application No. 62/618,617, filed on Mar. 5, 2018.

(51) Int. Cl.

| | |
|---|---|
| ***A41F 15/02*** | (2006.01) |
| ***A41F 15/00*** | (2006.01) |
| *A41F 1/00* | (2006.01) |

(52) U.S. Cl.

CPC ..... *A41F 15/002* (2013.01); *A41F 15/02* (2013.01)

(58) Field of Classification Search

CPC ..... A41F 15/02; A41F 15/002; A41F 19/00; A41F 18/00; A41F 17/00; A41F 15/005; A41F 1/006; A41C 3/12; A41C 1/12; A41C 3/0007; A41C 3/06; A41D 1/22; A41D 2400/00; A41D 31/0005; A41D 13/0017; A41D 27/10; Y10T 24/318; Y10T 24/316; Y10T 24/34; A41B 1/06; A41B 9/16

See application file for complete search history.

(56) References Cited

U.S. PATENT DOCUMENTS 322,397 A * 7/1885 Roggen et al. ..... A41D 1/06 2/269
1,648,776 A * 11/1927 McOrin ..... A41F 15/02 2/323
1,900,979 A * 3/1933 De Ment ..... A41F 15/02 24/299
2,113,795 A * 4/1938 Marshall ..... A41F 15/002 2/73
2,248,204 A * 7/1941 Snider ..... A41C 3/06 450/14
2,719,303 A * 10/1955 Wimmerstedt ..... A41F 15/02 2/105
3,508,555 A * 4/1970 Bogdon ..... A41C 3/00 450/3
3,940,039 A * 2/1976 Sasaki ..... A45F 5/02 224/264
4,475,252 A * 10/1984 Peyser ..... A41D 3/00 2/125
4,811,876 A * 3/1989 Riggi ..... A45F 3/02 2/268
4,879,768 A * 11/1989 McClees ..... A45F 3/12 224/264
5,149,293 A * 9/1992 Gable ..... A41F 15/02 2/101
5,357,633 A * 10/1994 Rael ..... A41D 13/08 2/126

(Continued)

*Primary Examiner* — Robert H Muromoto, Jr.

(74) *Attorney, Agent, or Firm* — Incubate IP; Randy R. Micheletti

(57) ABSTRACT

Devices for comfortably securing an off-the-shoulder garment to a user's arm/shoulder.

5 Claims, 20 Drawing Sheets

(56) References Cited

U.S. PATENT DOCUMENTS 5,643,643 A * 7/1997 Bernstein ..... D04D 7/00 156/70
5,666,701 A * 9/1997 Drummond ..... A45F 3/02 224/264
5,935,044 A * 8/1999 Brewster ..... A41F 15/02 2/323
6,081,925 A * 7/2000 Reiber ..... A41F 19/005 2/125
6,135,852 A * 10/2000 Young ..... A41F 15/02 2/268
6,146,239 A * 11/2000 Magliocchetti ..... A41F 19/005 450/1
6,155,906 A * 12/2000 May ..... A41F 15/002 450/1
6,206,752 B1 * 3/2001 Fagin ..... A41F 15/002 2/78.1
6,272,691 B1 * 8/2001 Henricksen ..... A41F 19/005 2/126
6,775,846 B1 * 8/2004 LaFauci ..... A41F 19/005 2/125
7,039,958 B2 * 5/2006 Henricksen ..... A41F 19/005 2/126
7,785,171 B1 * 8/2010 Baker ..... A41F 15/02 450/86
8,241,090 B2 * 8/2012 Michael ..... A41C 3/12 450/86
RE43,766 E * 10/2012 Ostaseski ..... 450/86
8,341,769 B2 * 1/2013 Fayle ..... A41D 31/14 2/269
8,366,511 B2 * 2/2013 Morello ..... A41F 15/002 450/86
8,545,288 B1 * 10/2013 Abood ..... A41C 3/00 450/91
8,549,763 B2 * 10/2013 Krawchuk ..... A41C 1/06 33/17 R
8,961,263 B2 * 2/2015 Magliocchetti ..... A41C 3/08 450/86
9,113,685 B2 * 8/2015 Iwai ..... A45C 3/06
9,565,879 B2 * 2/2017 LaHann ..... A41F 11/16
10,080,390 B2 * 9/2018 LaHann ..... A41D 1/215
10,154,722 B2 * 12/2018 Tian ..... F41C 33/002
10,390,646 B1 * 8/2019 Cox ..... B25G 1/04
2004/0089685 A1 * 5/2004 Chan ..... A45F 3/12 224/264
2004/0089686 A1 * 5/2004 Pratt ..... A63B 55/00 224/265
2005/0066426 A1 * 3/2005 White ..... A45F 3/12 2/271
2009/0013443 A1 * 1/2009 Perras ..... A41F 19/00 2/67
2009/0089910 A1 * 4/2009 Lopez ..... A41D 1/215 2/52
2011/0083254 A1 * 4/2011 Trutna ..... A41F 1/002 2/326
2011/0191945 A1 * 8/2011 Rodriguez ..... A41F 17/00 2/338
2012/0090078 A1 * 4/2012 von Olnhausen ..... A41C 3/08 2/326
2014/0162529 A1 * 6/2014 Magliocchetti ..... A41C 3/08 450/28
2014/0224389 A1 * 8/2014 Iwai ..... A45C 1/02 150/109
2014/0259269 A1 * 9/2014 Clements ..... A41D 13/01 2/69
2014/0352026 A1 * 12/2014 Greenblat ..... A41D 15/005 2/69
2015/0133027 A1 * 5/2015 Magliocchetti ..... A41C 3/08 450/28
2015/0150312 A1 * 6/2015 LaHann ..... A41D 1/215 2/49.1
2015/0237939 A1 * 8/2015 Banta ..... A41F 5/00 2/69
2016/0157538 A1 * 6/2016 Bortolotto ..... A45F 5/02 2/300
2016/0360811 A1 * 12/2016 Banta ..... A41F 5/00
2017/0035130 A1 * 2/2017 Hazzard ..... A41C 3/0028
2018/0213869 A1 * 8/2018 Andrews ..... A43C 5/00
2019/0053558 A1 * 2/2019 Spencer ..... A41F 19/00
2019/0183191 A1 * 6/2019 Caballero ..... A41D 1/00
2019/0307190 A1 * 10/2019 Kienel ..... A41B 7/04

* cited by examiner

DEVICE FOR COMFORTABLY MAINTAINING OFF-SHOULDER FASHIONS

PRIORITY CLAIM

This application claims priority to U.S. Provisional Patent Application Ser. No. 62/618,617, filed Mar. 5, 2018, and U.S. Provisional Patent Application Ser. No. 62/787,902, filed Jan. 3, 2019, the entire contents of each of which are incorporated herein by reference and relied upon.

FIELD OF THE DISCLOSURE

The present disclosure provides devices for comfortably maintaining of off the shoulder fashions. In some embodiments, the devices include a smooth (a fabric with slip or sateen texture), elastic, and adjustable band for positioning under a user's arm to draw tension down from where the band is attached to the top of the woman's shirt, top, or blouse to maintain an intended off the shoulder look.

BACKGROUND

Off the shoulder fashion could allow for a woman to convey confidence, authority, intelligence, beauty, and competence. However, what tends to happen when one wears such a garment, is in order to keep the off the shoulder neck line in place, one must resist significant movement of the shoulder and related anatomy. This limits the gamut of behaviors for social interaction. For example, one cannot wave, put hair behind one's ear, dance, or even write, without devoting mental energy to the placement of the garment to determine if the garment must be tugged back into place again. Her body language is now a direct opposite of what she intended to portray by wearing the garment in the first place. She wears this off the shoulder fashion with the intention of possibly conveying happiness, flirtation, confidence and beauty but the garment ends up imprisoning her making her look depressed and unapproachable with slumped unmovable shoulders.

Many women shun all fashion that celebrate the shoulders, and lower neck and décolletage area, maybe subconsciously knowing that wearing the garment is more trouble than the worth of managing it all day and/or night rather than fully engaging in the full milieu of the environment. Many have sought a product on the market to solve the problem of the shoulders riding up. While fashion tape may provide some benefit, fashion tape is known to frequently stick to the body and lose adherence to the fabric over time. Positioning of the garment is not maintained over time, and the user is commonly left with residue or painful removal of tape from the skin.

A need persists for comfortable methods for maintaining off-the-shoulder fashions.

SUMMARY

In one embodiment, the present disclosure provides an adjustable positioning device for comfortable maintenance of off the shoulder fashions, the device comprising: a band of material; a first securement device bar pin disposed at a first end of the band; a second securement device including a baretachment component mated with a bar pin component, wherein the second securement device is slidably disposed along a first loop of the band opposite the first end of the band; and a tri-glide buckle for enabling adjustment of usable length of the device, wherein the tri-glide buckle is disposed between the first end of the band and the first loop of the band, wherein the baretachment component includes a window gap for slidably mating with the band of elastic material and for preventing the band of elastic material from rotating relative to baretachment component when the device is in use under an arm of a user.

In another embodiment, the present disclosure provides an off-the-shoulder garment comprising: a securing device attached at a first end to a first, posterior portion of the garment and further attached at a second end of the securing device to a second, anterior portion of the garment; and an arm hole defined at least in part by the securing device and a segment of fabric of the garment for covering at least a portion of an outer surface of an arm of a user, wherein the securing device is disposed below an axilla (e.g., armpit) of the user when the user wears the garment.

BRIEF DESCRIPTION OF DRAWINGS

Some embodiments of the present disclosure are illustrated as an example and are not limited by the figures of the accompanying drawings, in which like references may indicate similar elements and in which.

Figure 1:
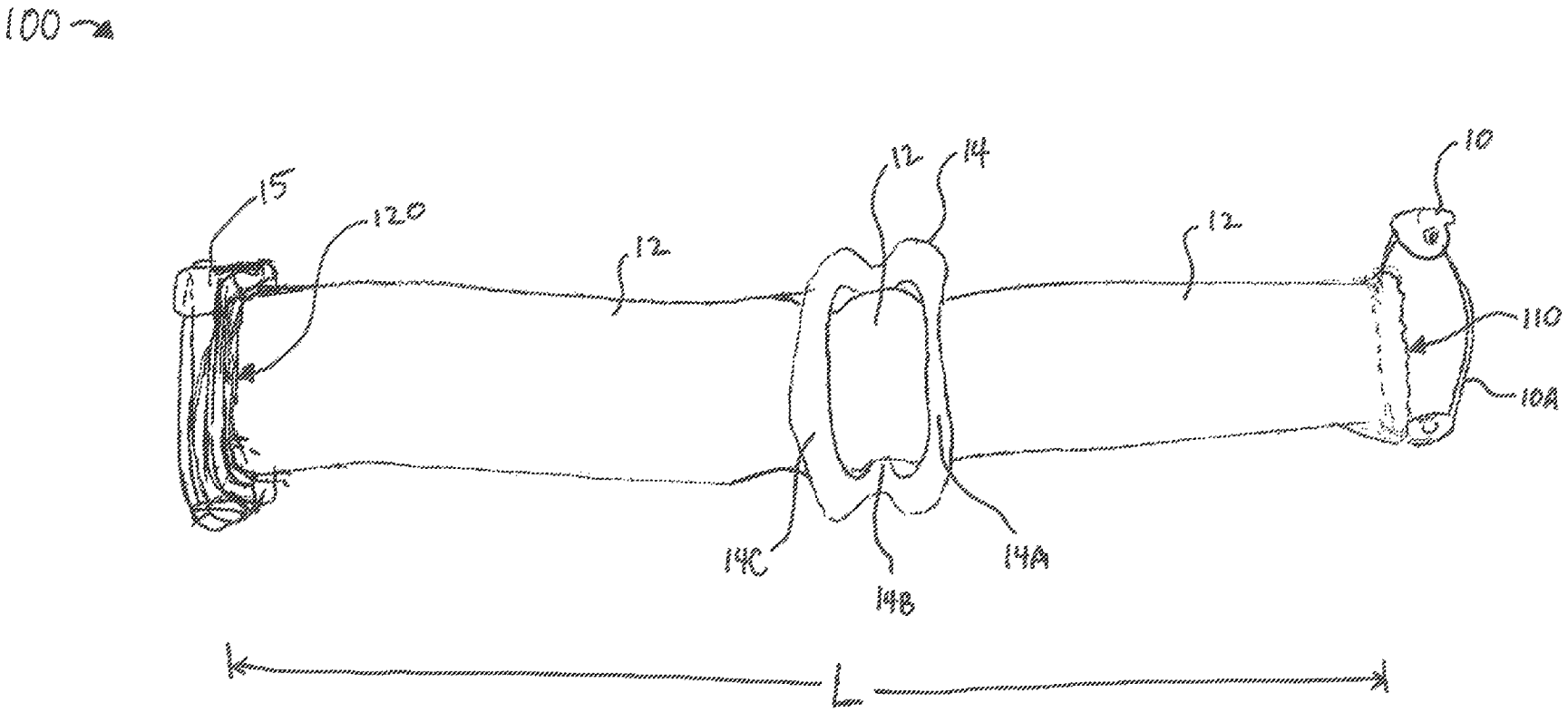
FIG. 1 shows a top perspective view of a device for maintaining off-the-shoulder fashions consistent with one embodiment of the present disclosure.

These and other embodiments are described in additional detail below.

DETAILED DESCRIPTION

Referring generally to FIGS. 1-20, the present disclosure provides devices for comfortably securing an off-the-shoulder garment to a user's arm/shoulder. In general, devices of the present disclosure comprise a band of material, a first securement device at a first end of the band of material, and a second securement device slidably disposed along the band of material. The securement devices are configured to attach (e.g., removably attach) to the inside of an off-the-shoulder garment, such as a shirt or a blouse, in a manner that reduces or eliminates creepage of the off-the-shoulder portion of the garment up and over the wearer's exposed shoulder.

Referring now specifically to FIGS. 1-7, a device 100 for comfortably maintaining an off-the-shoulder fashion according to one embodiment of the present disclosure comprises a band of material 12, a first securement device 10 at a first end of the band of material 12A, a second securement device 15 slidably disposed along the band of material 12, and a tri-glide buckle 14 slidably disposed along the band of material 12 between the first securement device 10 and the second securement device 15.

The band of material 12 may be any suitable shape, so long as the first securement device 10 and the second securement device 15 can be secured thereto, and the tri-glide buckle 14 can be slidably disposed along a length of the band of material 12, for example to enable a user to adjust the usable length L of the band of material 12. The band of material 12 includes a first end 12A and a second end 12B opposite the first end 12A. As used herein, the term "opposite the first end 12A" refers to the conformation of the band of material 12 in its fully unformed state, that is, before the band of material is folded, looped, stitched, or otherwise formed into the finished shape of the device 100.

Figure 2:
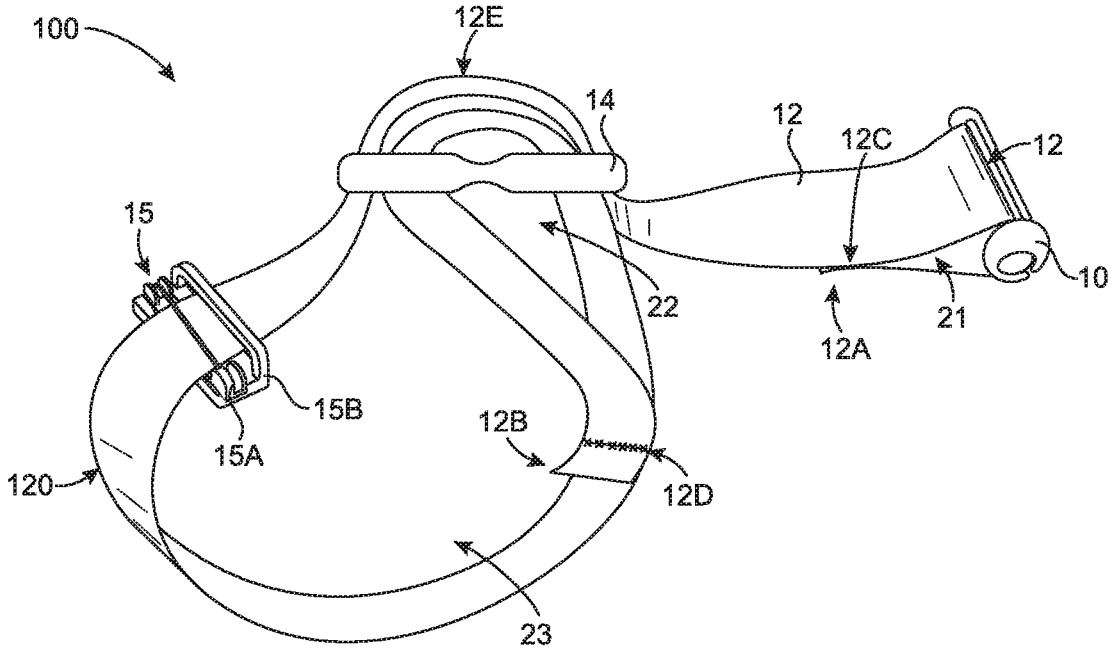
FIG. 2 shows a perspective view from the side of the device of FIG. 1.

In some embodiments, such as that shown in FIGS. 1-7, the band of material 12 is folded and one or more portions secured (e.g., temporarily secured and/or permanently secured) to form at least one loop. For example, as shown in FIG. 2, the band of material 12 may be configured to form three loops including: a first loop 21 formed by securing the first end 12A of the band of material 12 to a portion 12C of the band of material 12; a second loop 22 formed by securing the second end 12B of the band of material 12 to a second portion 12D of the band of material 12; and a third loop 23 formed by securing the second loop 22 to a third portion 12E of the band of material 12.

The various loops 21,22,23, etc. . . . enable securement devices 10,15 and adjustment devices (e.g., tri-glide buckle 14) to be secured to the band of material 12 to achieve desired functions. For example, securement of at least one adjustment device (e.g., tri-glide buckle 14) along the band of material 12 enables the user to adjust the usable length L of the device 100 to accommodate fashions and users of different sizes and to adjust tension applied across the fashion garment by the device 100. Inclusion of at least two securement devices 10,15 along the band of material 12 enables the user to attach the first end 110 of the device 100 and the second end 120 of the device 100 to first and second attachment points A1,A2 of the garment (see, e.g., FIG. 8), respectively.

The band of material 12 may comprise any suitable material, such as cotton, elastic, silk, satin, nylon, rayon, polyester, denim, rubber, leather, pleather, or a combination of any two or more of the foregoing. In some embodiments, the band of material 12 comprises elastic. In some embodiments, the band of material 12 consists essentially of elastic. In some embodiments, the band of material 12 consists of elastic. Due to the envisioned placement of the device 100 near a major joint of the human body (e.g., the shoulder), the band of material 12 is formed of a material that stretches at least about 5% along its usable length L, for example at least about 5%, at least about 6%, at least about 7%, at least about 8%, at least about 9%, at least about 10%, at least about 11%, at least about 12%, at least about 13%, at least about 14%, at least about 15%, at least about 16%, at least about 17%, at least about 18%, at least about 19%, or at least about 20% along its usable length L. However, too much stretch along its usable length L will diminish, or even destroy, the intended functional benefit of the device 100. Accordingly, in some embodiments, the band of material 12 is formed of a material that stretches no more than about 50% along its usable length L, for example no more than about 50%, no more than about 45%, no more than about 40%, no more than about 35%, no more than about 30%, no more than about 25%, no more than about 20%, no more than about 15%, or no more than about 10% along its usable length L.

The first securement device 10 attaches the first end 110 of the device 100 to a first attachment point A1 of a garment G. The first securement device 10 may include, for example, a bar pin including a pin bar 10A that can be passed through the first attachment point A1 of the garment G to temporarily affix the first end 110 of the device 100 to the first attachment point A1 of the garment G. In other embodiments, the first securement device 10 may include a magnet, a snap, one half of a hook-and-loop type fastener (e.g., VELCRO), a button, or a button hole. In embodiments wherein the first securement device 10 includes a magnet, the first attachment point A1 of the garment G may include a magnet for magnetically mating with the magnet of the first securement device 10. In embodiments wherein the first securement device 10 includes a snap, the first attachment point A1 of the garment G may include a complementary snap receiver for physically mating with the snap of the first securement device 10. In embodiments wherein the first securement device 10 includes one half of a hook-and-loop fastener, the first attachment point A1 of the garment G may include the complementary half of the hook-and-loop fastener for physically mating with the first half of hook-and-loop fastener of the first securement device 10. In embodiments wherein the first securement device 10 includes a button, the first attachment point A1 of the garment G may include a button hole for physically mating with the button of the first securement device 10. In embodiments wherein the first securement device 10 includes a button hole, the first attachment point A1 of the garment G may include a button for physically mating with the button hole of the first securement device 10.

In some embodiments, such as shown in FIG. 2, the first securement device 10 is secured to the band of material 12 by a first loop 21 formed in the band of material 12. In such embodiments, the first end 12A of the band of material may be passed through the first securement device 10 (e.g., a bar pin) and secured to a first portion 12C of the band of material 12A, for example by stitches, heat seal, or any other secure fastening structure.

The second securement device 15 is slidably disposed along the band of material 12 at the second end 120 of the device 100, and attaches the second end 120 of the device 100 to a second attachment point A2 of the garment G.

Figure 3:
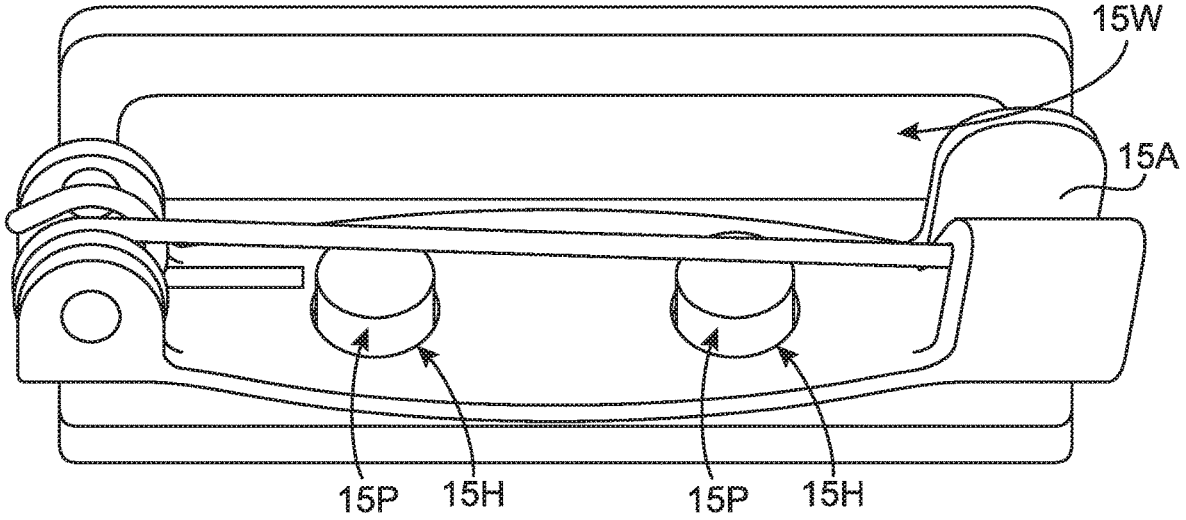
FIG. 3 shows a top perspective view of a securement device for use with a device consistent with the present disclosure, including a Baretachment piece mated with a bar pin.
Figure 4:
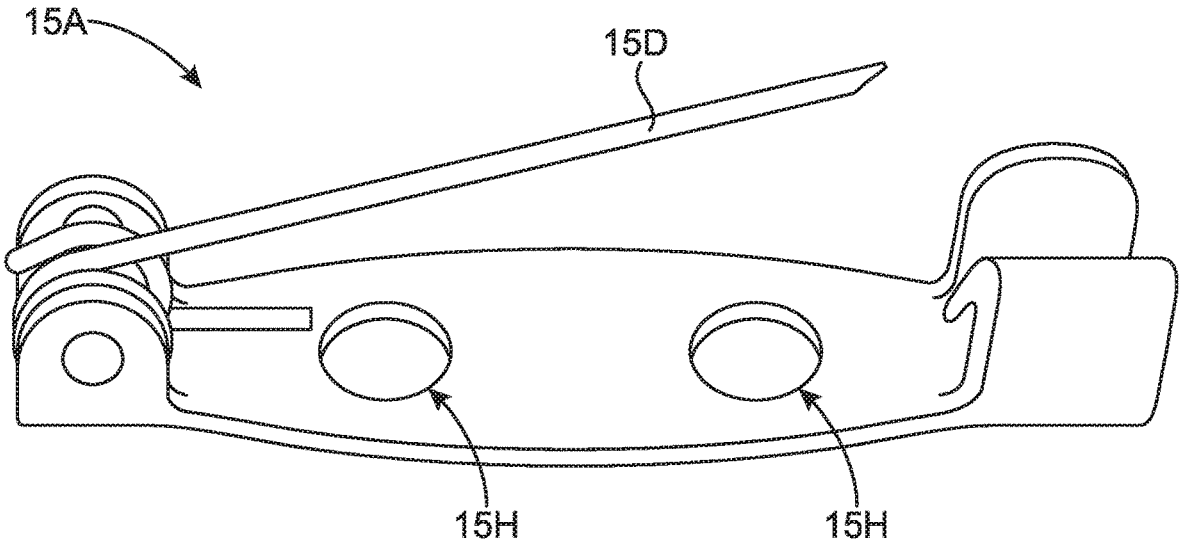
FIG. 4 shows a perspective view of a bar pin component of the securement device of FIG. 3 consistent with one embodiment of the present disclosure.
Figure 5:
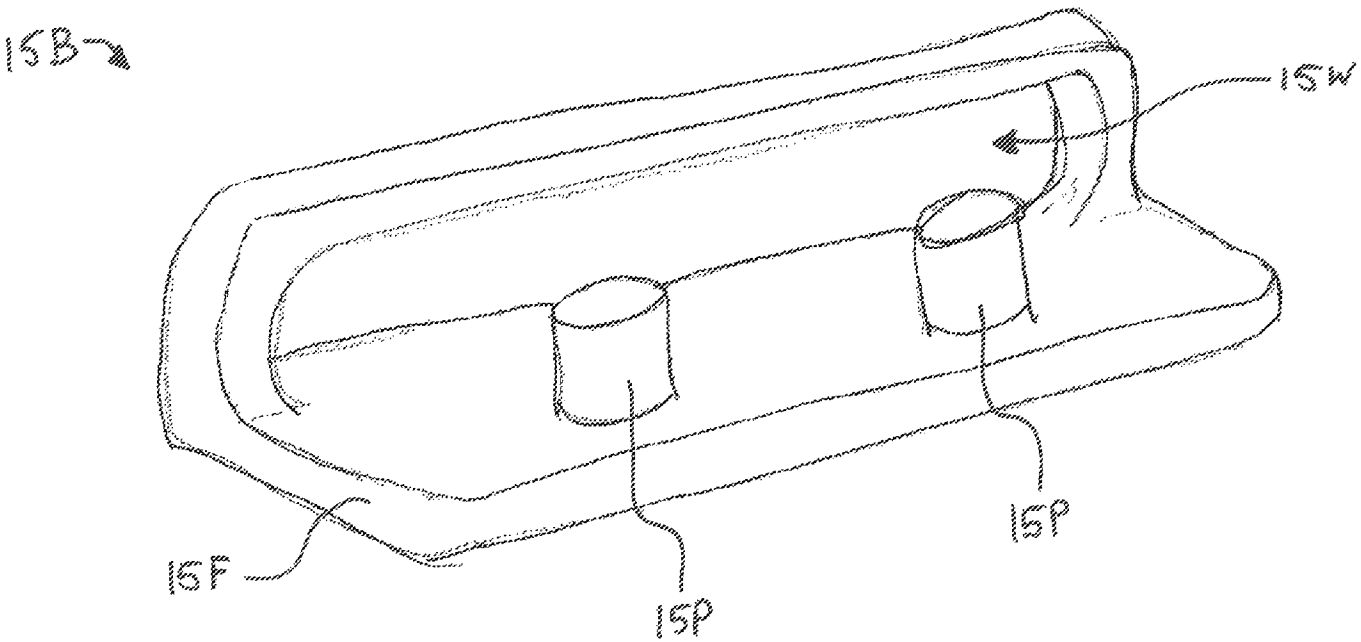
FIG. 5 shows a perspective view of the Baretachment piece component of the securement device of FIG. 3 consistent with one embodiment of the present disclosure.

In some embodiments, such as that shown in FIGS. 3-5, the second securement device 15 includes a bar pin component 15A and a Baretachment component 15B. The bar pin component 15A may include a pin 15D that can be opened or closed by a user and that can be inserted through the second attachment point A2 of the garment G to temporarily affix the second securement device 15 to the garment G. The bar pin component 15A may also include one or more attachment points 15H for securing the bar pin component 15A to the Baretachment component 15B. For example, as shown in FIG. 4, the bar pin component 15A may include one or more holes 15H through which one or more anchors 15P of the Baretachment component 15B can be passed and secured. The bar pin component 15A may be formed of any suitable material, such as brass, nickel, steel, or sturdy resin (e.g., polycarbonate).

The Baretachment component 15B includes at least one window 15W through which the band of material 12 may pass, but which hinders the band of material 12 from twisting or folding over on itself along its long dimension. Thus, the window 15W preferably has inside dimensions slightly smaller than, about the same dimensions as, or slightly larger than the maximum dimensions of the band of material 12 (e.g., the lateral cross-sectional dimensions of the band of material 12 when it is in its unstretched state). In some embodiments, the window 15W has a height that is not more than about 200% of the thickness of the band of material 12 in its unstretched state, for example not more than about 200%, not more than about 175%, not more than about 150%, not more than about 125%, not more than about 100%, not more than about 95%, not more than about 90%, not more than about 85%, not more than about 80%, not more than about 75%, or not more than about 70% of the thickness of the band of material 12 in its unstretched state. The narrow passageway defined by the window 15W reduces or even eliminates the possibility that the band of material 12 will twist or fold on itself to create an uncomfortable contact between the band of material 12 and the user's skin.

The Baretachment component 15B also includes a base plate 15F that shields the user's skin from directly contacting the bar pin component 15A to prevent the bar pin component 15A from pinching, poking, scratching, chafing or digging into the user's skin.

The Baretachment component 15B also includes one or more attachment points 15P for securing the Baretachment component 15B to the bar pin component 15A. For example, as shown in FIG. 5, the Baretachment component 15B may include two posts 15P for mating with two holes 15H in the bar pin component 15A. To assemble the Baretachment component 15B, the posts 15P are passed through the holes 15H, and then the posts 15P are deformed to tightly secure the Baretachment component 15B to the bar pin component 15A. In some embodiments, the Baretachment component 15B is formed of a heat-deformable resin (e.g., polycarbonate, polyethylene, polypropylene, etc.) and the step of deforming the posts 15P comprises heating the posts 15P, applying pressure to the posts 15P to deform the posts 15P, and then cooling the posts 15P. In some embodiments, an adhesive secures the Baretachment device 15B to the bar pin 15A, in addition to or instead of posts 15P. In other embodiments, the second securement device 15, other than the pin 15D, is formed as a single unit, such as by additive manufacturing methods (e.g., 3D printing, injection molding, or metal casting) or subtractive manufacturing methods.

Figure 6:
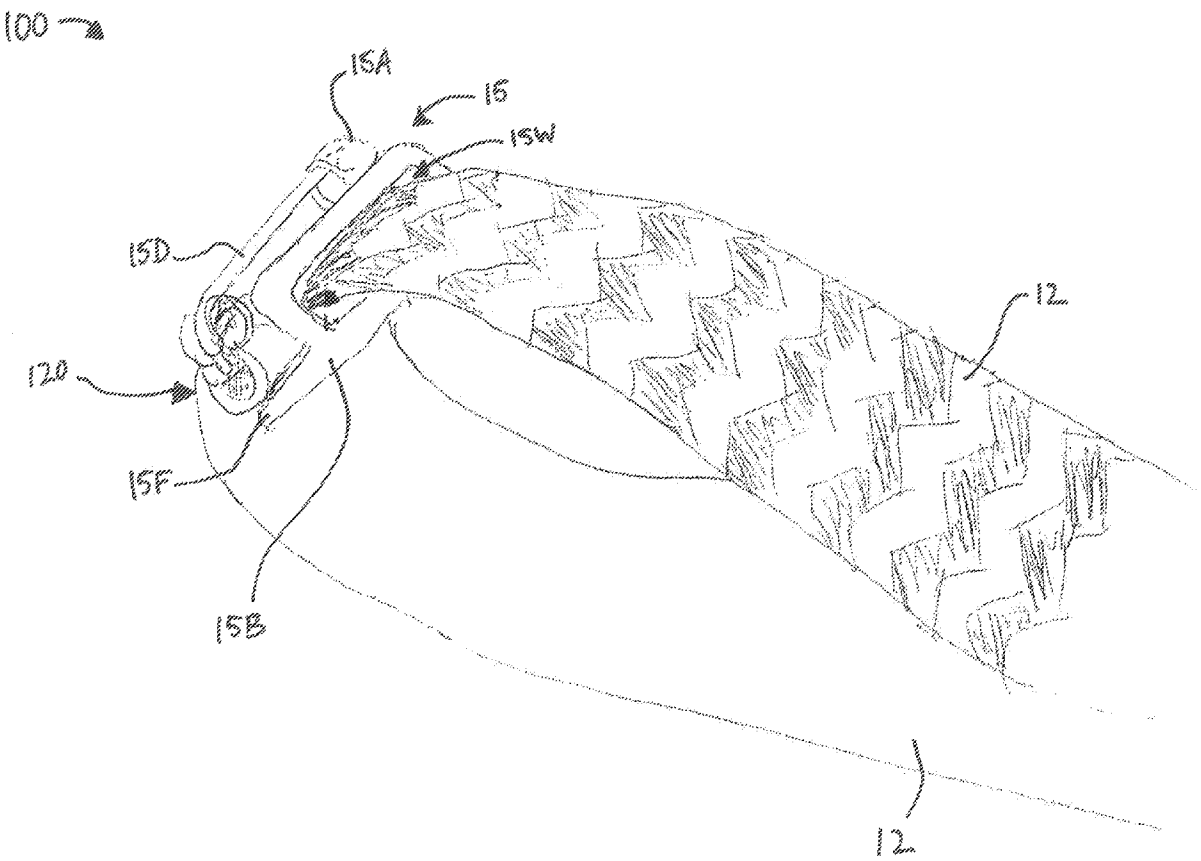
FIG. 6 shows a side perspective view of the combination Baretachment piece-bar pin of FIG. 5 through which a band has been passed consistent with one embodiment of the present disclosure.
Figure 7:
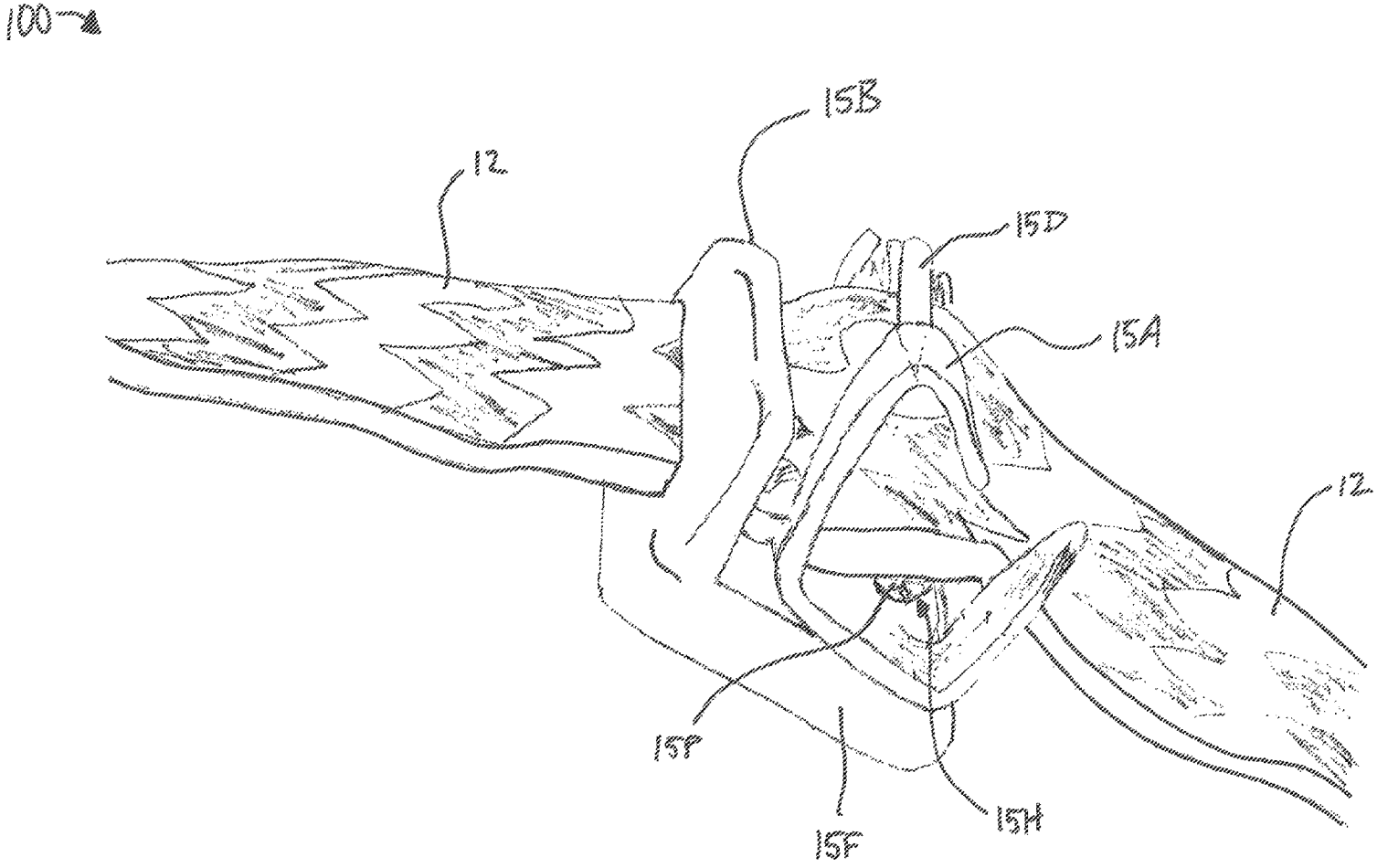
FIG. 7 shows a side perspective view of the embodiment shown in FIG. 6.

FIG. 6 shows this embodiment of the second securement device 15 slidably disposed along the band of material 12 and near the second end 120 of the device 100. In this view, the band of material 12 passes through the window 15W of the Baretachment component 15B and under the pin 15D of the bar pin component 15A.

In other embodiments, the second securement device 15 may include, for example, a bar pin including a pin bar 15A that can be passed through the second attachment point A2 of the garment G to temporarily affix the second end 120 of the device 100 to the second attachment point A2 of the garment G, wherein the second securement device 15 does not include a Baretachment component 15B. In other embodiments, the second securement device 15 may include a magnet, a snap, one half of a hook-and-loop type fastener (e.g., VELCRO), a button, or a button hole. In embodiments wherein the second securement device 15 includes a magnet, the second attachment point A2 of the garment G may include a magnet for magnetically mating with the magnet of the second securement device 15. In embodiments wherein the second securement device 15 includes a snap, the second attachment point A2 of the garment G may include a complementary snap receiver for physically mating with the snap of the second securement device 15. In embodiments wherein the second securement device 15 includes one half of a hook-and-loop fastener, the second attachment point A2 of the garment G may include the complementary half of the hook-and-loop fastener for physically mating with the first half of hook-and-loop fastener of the second securement device 15. In embodiments wherein the second securement device 15 includes a button, the second attachment point A2 of the garment G may include a button hole for physically mating with the button of the second securement device 15. In embodiments wherein the second securement device 15 includes a button hole, the second attachment point A2 of the garment G may include a button for physically mating with the button hole of the second securement device 15.

The tri-glide buckle 14 enables adjustment of the usable length L of the device 100. As shown in FIG. 2, the tri-glide buckle 14 is secured near the second end 12B of the band of material 12, for example by a second loop 22 through which a middle bar of the tri-glide buckle 14 passes. The band of material 12 passes under a first end bar 14A, over the portion of the band of material 12 that forms the second loop 22 and its associated middle bar 14B, and under a third bar 14C to form a slidably adjustable third loop 23 in the band of material 12 adjacent to the second loop 22. The tri-glide buckle 14 may be formed of any suitable material such as metal or durable plastic.

Figure 8:
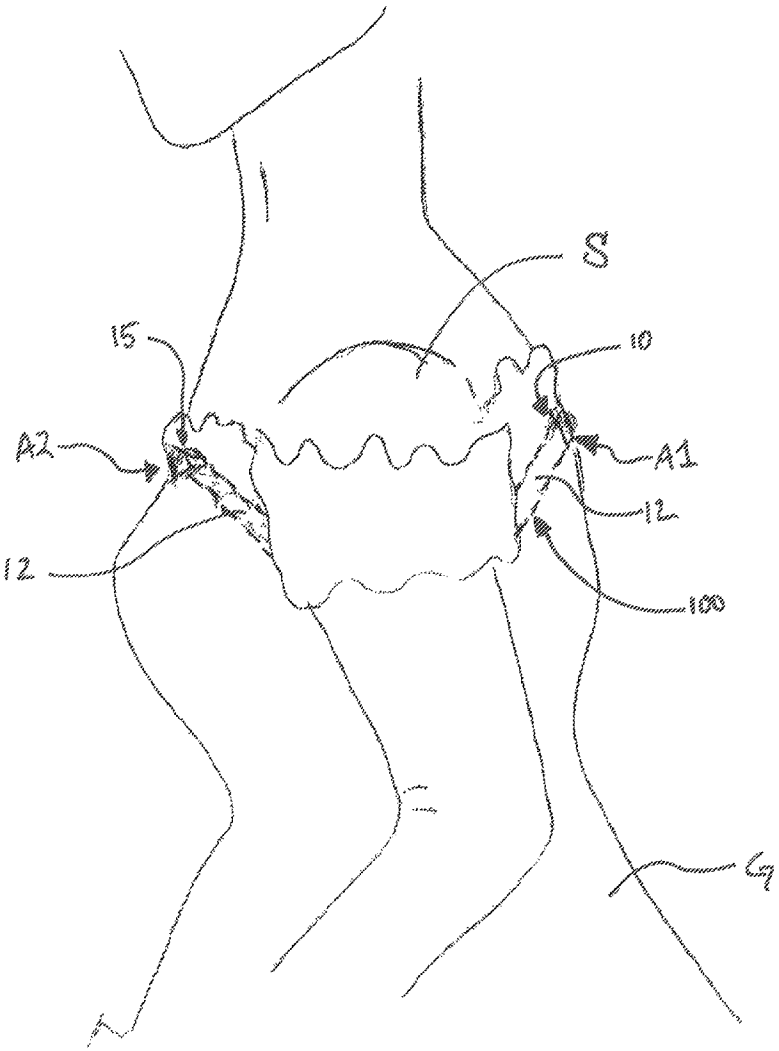
FIG. 8 illustrates placement of the device of FIG. 1 to an off-the-shoulder garment consistent with one embodiment of the present disclosure.
Figure 9:
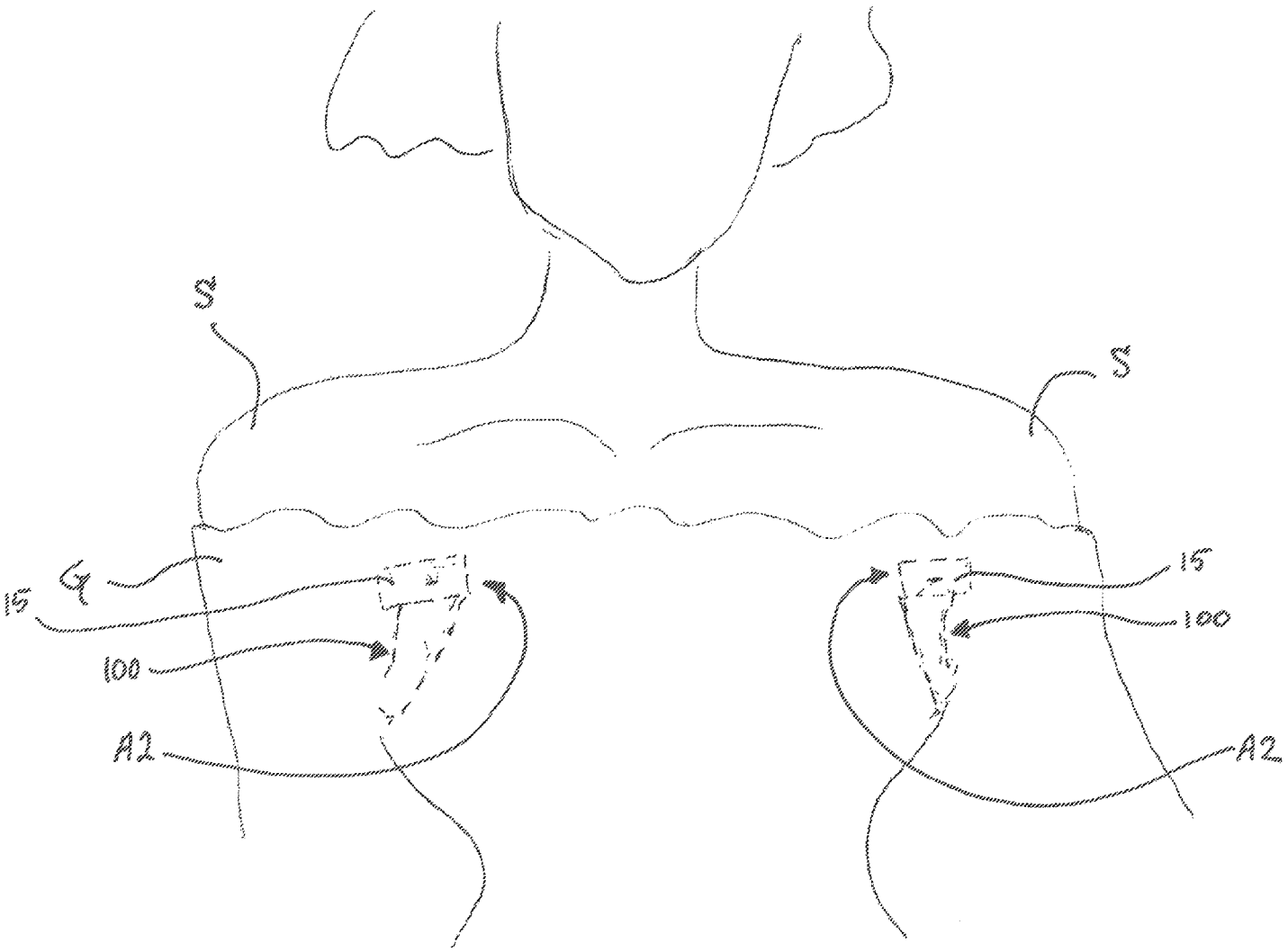
FIG. 9 illustrates a front perspective view of the embodiment shown in FIG. 8.
Figure 10:
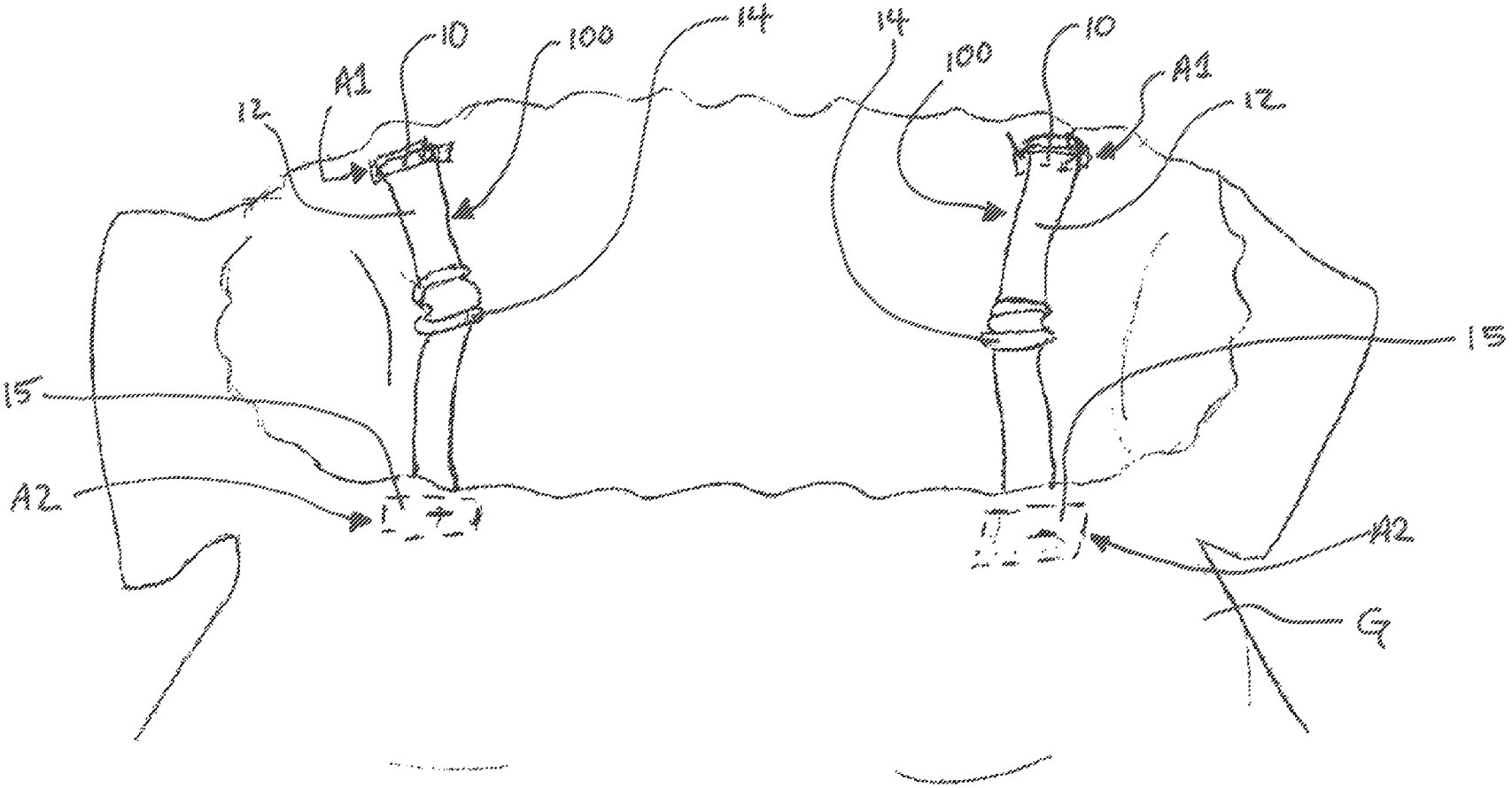
FIG. 10 shows a top perspective view of use of two devices consistent with the embodiment shown in FIG. 1 inside an off-the-shoulder blouse.

Use of a device 100 consistent with FIGS. 1-7 is shown representatively in FIGS. 8-10. Either before or after placing an off-the-shoulder garment G on a user, the first securement device 10 is affixed to the first attachment point A1 of the garment G, and the second securement device 15 is affixed to the second attachment point A2 of the garment G. The user's shoulder S and arm A should be positioned above the device 100 to ensure that the garment G does not creep up or down relative to the user's shoulder S. The tension level between the first attachment point A1 and the second attachment point A2 can be adjusted by moving the tri-glide buckle 14 along the band of material 12; by shortening the usable length L of the device 100, the tension between the first attachment point A1 and the second attachment point A2 is increased, while lengthening the usable length L of the device 100 reduces the tension between the first attachment point A1 and the second attachment point A2. In other embodiments, the first securement device 10 may be affixed to the second attachment point A2, and the second securement point 15 may be affixed to the first attachment point A1.

Figure 11:
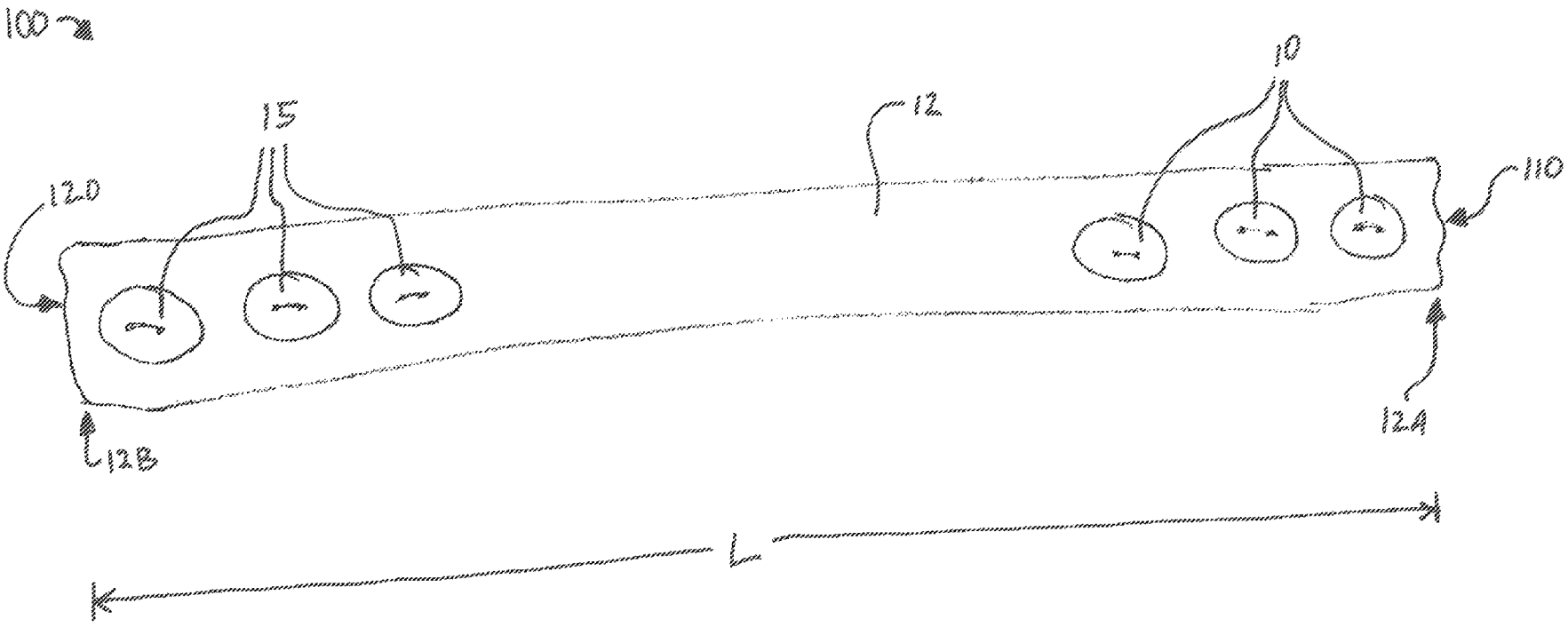
FIG. 11 shows a top perspective view of a device for maintaining off-the-shoulder fashions consistent with another embodiment of the present disclosure.
Figure 12:
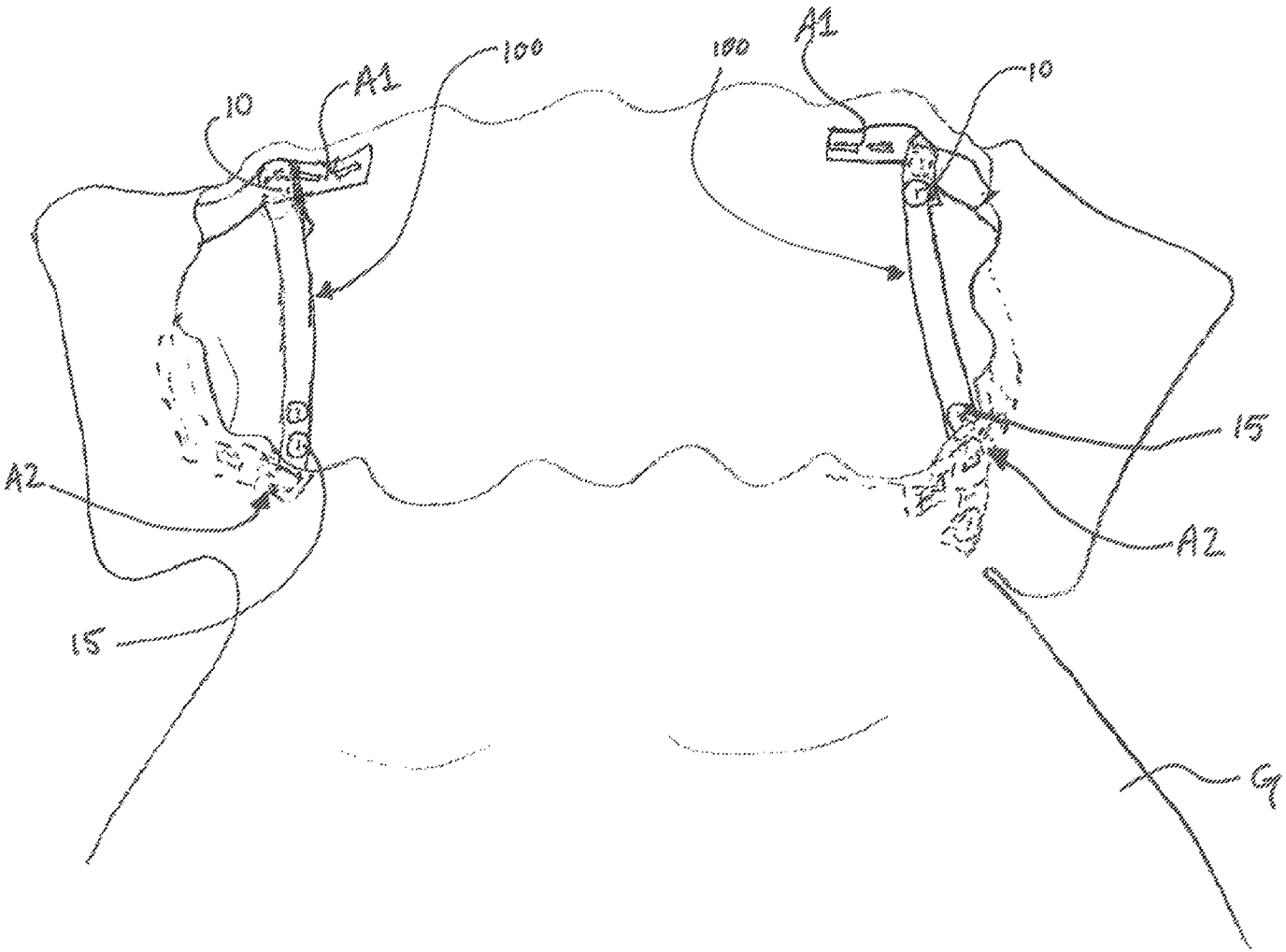
FIG. 12 shows a top perspective view of a shirt for mating with two devices consistent with the embodiment of FIG. 11.

Referring now to FIGS. 11-12, another specific embodiment of a device 100 for comfortably maintaining off-the-shoulder fashions is representatively shown. In this embodiment, the band of material 12 includes no loops, but instead is a substantially straight length of material.

The first securement device 10 includes one or more buttons affixed near the first end 110 of the device and for mating with one or more button holes at the first attachment point A1 of the garment. The second securement device 15 includes one or more buttons affixed near the second end 120 of the device and for mating with one or more button holes at the second attachment point A2 of the garment. In this embodiment, the usable length L of the device 100 is adjustable by selecting a button from the first securement device 10 and a button from the second securement device 15 spaced a desired distance apart to affix to the first attachment point A1 and the second attachment point A2 of the garment G, respectively.

The band of material 12 may comprise any suitable material, such as cotton, elastic, silk, satin, nylon, rayon, polyester, denim, rubber, leather, pleather, or a combination of any two or more of the foregoing. In some embodiments, the band of material 12 comprises elastic. In some embodiments, the band of material 12 consists essentially of elastic. In some embodiments, the band of material 12 consists of elastic. Due to the envisioned placement of the device 100 near a major joint of the human body (e.g., the shoulder), the band of material 12 is formed of a material that stretches at least about 5% along its usable length L, for example at least about 5%, at least about 6%, at least about 7%, at least about 8%, at least about 9%, at least about 10%, at least about 11%, at least about 12%, at least about 13%, at least about 14%, at least about 15%, at least about 16%, at least about 17%, at least about 18%, at least about 19%, or at least about 20% along its usable length L. However, too much stretch along its usable length L will diminish, or even destroy, the intended functional benefit of the device 100. Accordingly, in some embodiments, the band of material 12 is formed of a material that stretches no more than about 50% along its usable length L, for example no more than about 50%, no more than about 45%, no more than about 40%, no more than about 35%, no more than about 30%, no more than about 25%, no more than about 20%, no more than about 15%, or no more than about 10% along its usable length L.

Use of a device 100 consistent with FIG. 11 is shown representatively in FIG. 12. Either before or after placing an off-the-shoulder garment G on a user, the first securement device 10 is affixed to the first attachment point A1 of the garment G, and the second securement device 15 is affixed to the second attachment point A2 of the garment G. The user's shoulder S and arm A should be positioned above the device 100 to ensure that the garment G does not creep up or down relative to the user's shoulder S. The tension level between the first attachment point A1 and the second attachment point A2 can be adjusted by affixing a different first securement device 10 (e.g., button) to the first attachment point A1 and/or by affixing a different second securement device 15 (e.g., button) to the second attachment point A2 to shorten (increase tension) or lengthen (decrease tension) the usable length L of the device 100. In other embodiments, the first securement device 10 may be affixed to the second attachment point A2, and the second securement point 15 may be affixed to the first attachment point A1.

Figure 13:
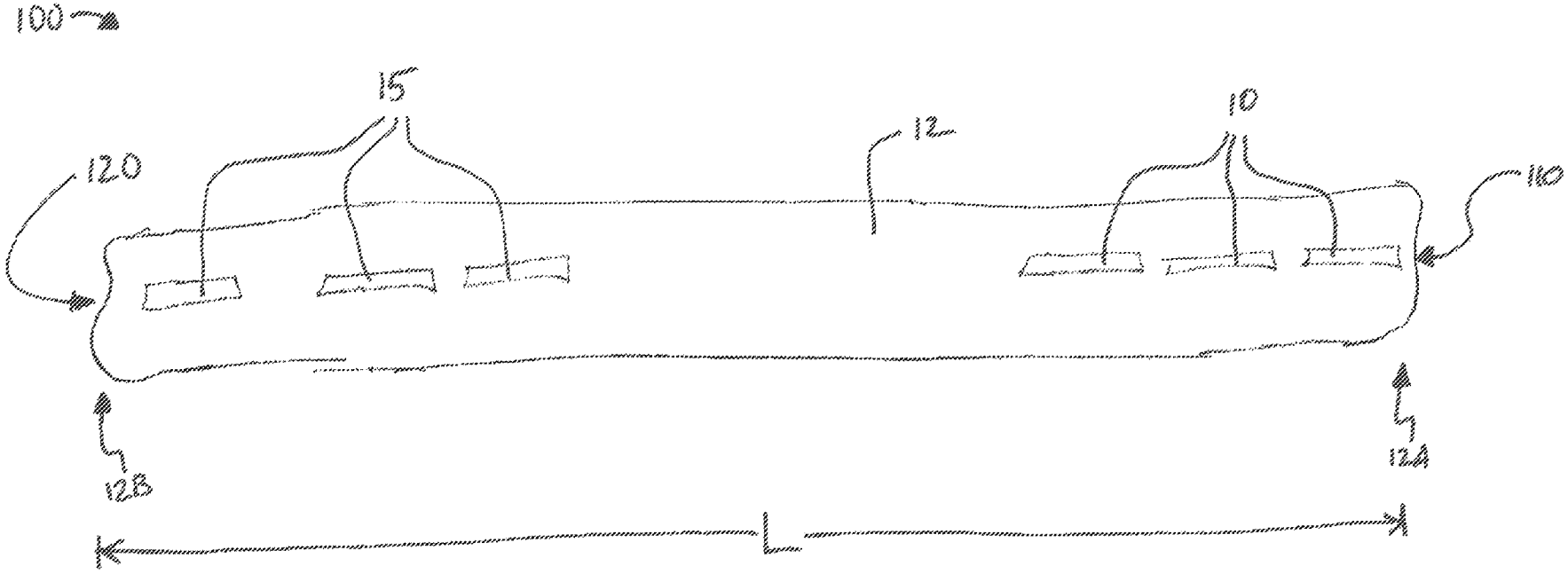
FIG. 13 shows a top perspective view of a device for maintaining off-the-shoulder fashions consistent with another embodiment of the present disclosure.
Figure 14:
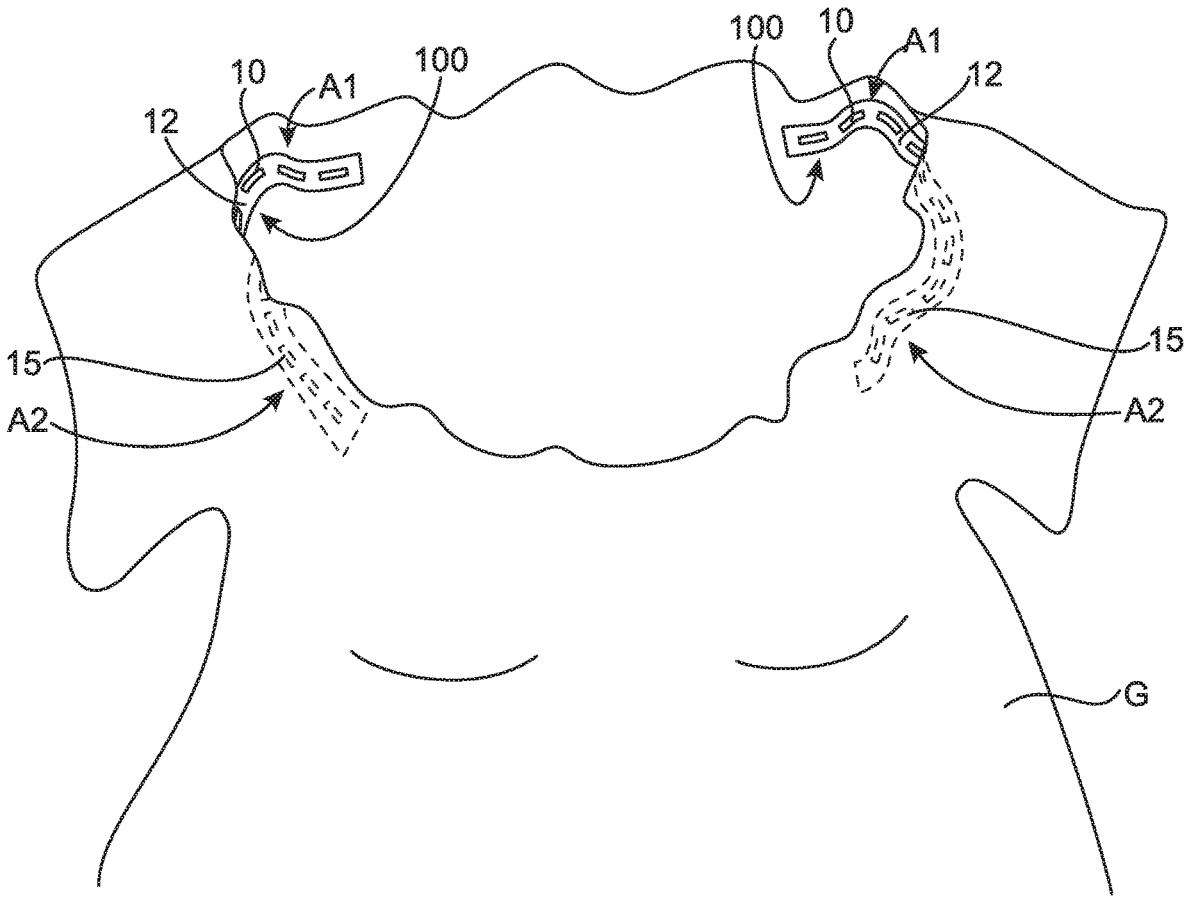
FIG. 14 shows a top perspective view of an off-the-shoulder shirt mated with two devices consistent with FIG. 13.
Figure 15:
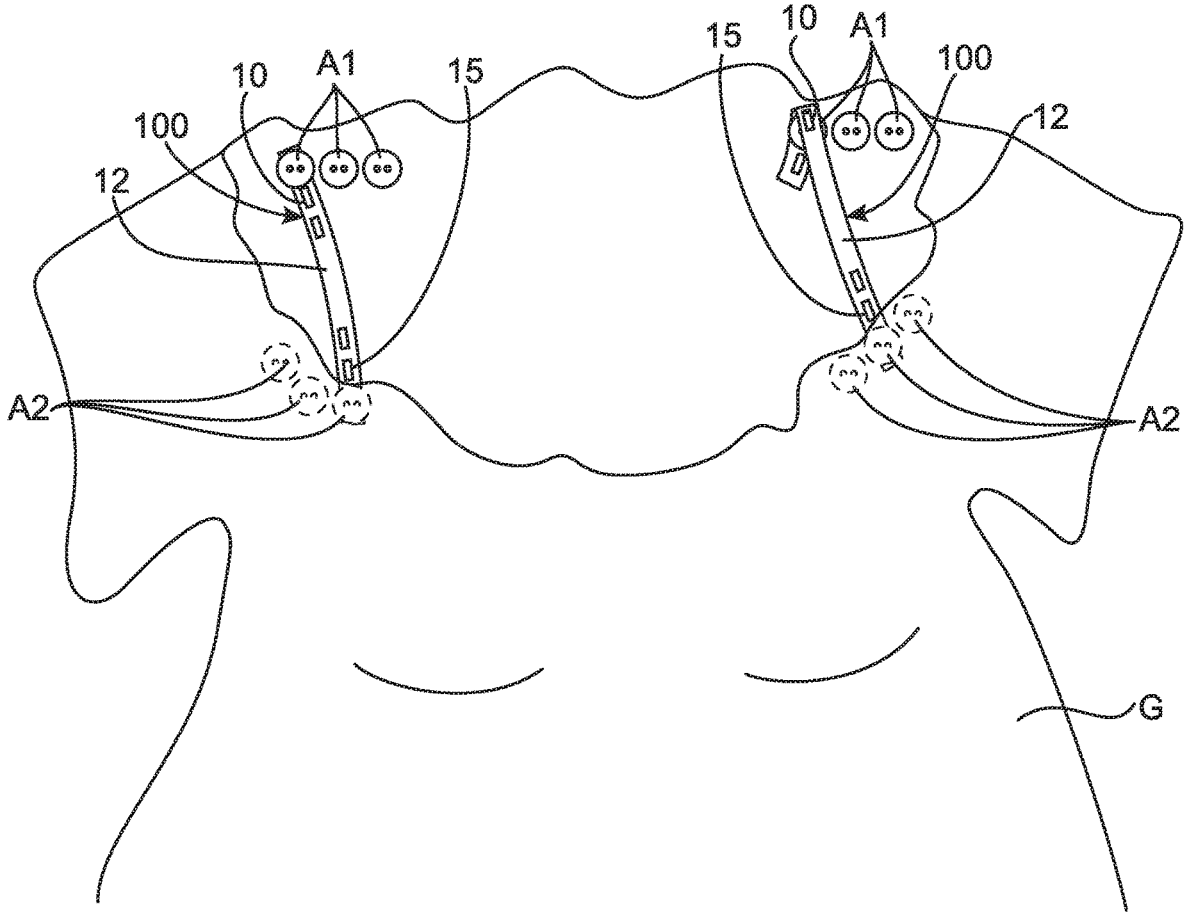
FIG. 15 shows a top perspective view of a shirt for mating with two devices consistent with FIG. 13.

Referring now to FIGS. 13-15, another specific embodiment of a device 100 for comfortably maintaining off-the-shoulder fashions is representatively shown. In this embodiment, the band of material 12 includes no loops, but instead is a substantially straight length of material.

The first securement device 10 includes one or more button holes arranged near the first end 110 of the device and for mating with one or more buttons at the first attachment point A1 of the garment. The second securement device 15 includes one or more button holes affixed near the second end 120 of the device and for mating with one or more buttons at the second attachment point A2 of the garment. In this embodiment, the usable length L of the device 100 is adjustable by selecting a button hole from the first securement device 10 and a button hole from the second securement device 15 spaced a desired distance apart to affix to the first attachment point A1 and the second attachment point A2 of the garment G, respectively. In some embodiments, such as that shown in FIG. 15, the garment G may include more than one button at the first attachment point A1 and/or at the second attachment point A2 to provide additional options for affixing the first securement device 10 and the second securement device 15 to provide a desired tension level between the first attachment point A1 and the second attachment point A2.

The band of material 12 may comprise any suitable material, such as cotton, elastic, silk, satin, nylon, rayon, polyester, denim, rubber, leather, pleather, or a combination of any two or more of the foregoing. In some embodiments, the band of material 12 comprises elastic. In some embodiments, the band of material 12 consists essentially of elastic. In some embodiments, the band of material 12 consists of elastic. Due to the envisioned placement of the device 100 near a major joint of the human body (e.g., the shoulder), the band of material 12 is formed of a material that stretches at least about 5% along its usable length L, for example at least about 5%, at least about 6%, at least about 7%, at least about 8%, at least about 9%, at least about 10%, at least about 11%, at least about 12%, at least about 13%, at least about 14%, at least about 15%, at least about 16%, at least about 17%, at least about 18%, at least about 19%, or at least about 20% along its usable length L. However, too much stretch along its usable length L will diminish, or even destroy, the intended functional benefit of the device 100. Accordingly, in some embodiments, the band of material 12 is formed of a material that stretches no more than about 50% along its usable length L, for example no more than about 50%, no more than about 45%, no more than about 40%, no more than about 35%, no more than about 30%, no more than about 25%, no more than about 20%, no more than about 15%, or no more than about 10% along its usable length L.

Use of a device 100 consistent with FIG. 13 is shown representatively in FIGS. 14-15. Either before or after placing an off-the-shoulder garment G on a user, the first securement device 10 is affixed to the first attachment point A1 of the garment G, and the second securement device 15 is affixed to the second attachment point A2 of the garment G. The user's shoulder S and arm A should be positioned above the device 100 to ensure that the garment G does not creep up or down relative to the user's shoulder S. The tension level between the first attachment point A1 and the second attachment point A2 can be adjusted by affixing a different first securement device 10 (e.g., button hole) to the first attachment point A1 and/or by affixing a different second securement device 15 (e.g., button hole) to the second attachment point A2 to shorten (increase tension) or lengthen (decrease tension) the usable length L of the device 100. In other embodiments, the first securement device 10 may be affixed to the second attachment point A2, and the second securement point 15 may be affixed to the first attachment point A1.

Figure 16:
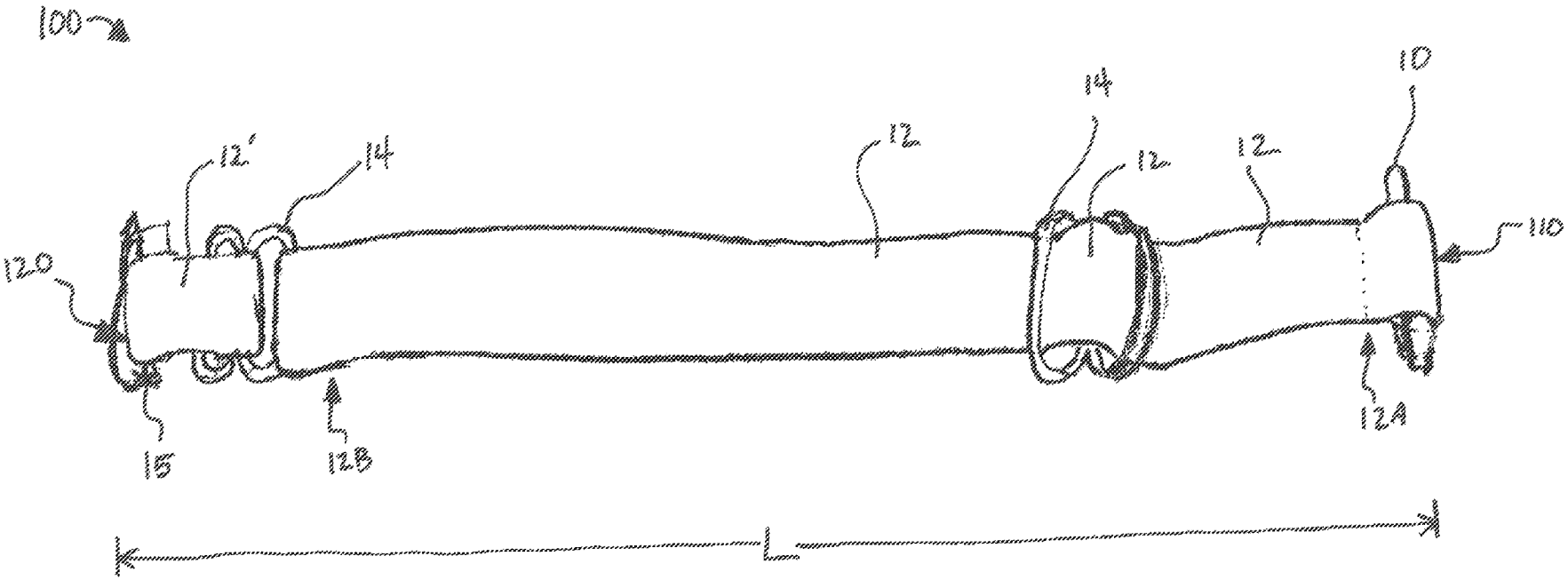
FIG. 16 shows a top perspective view of a device for comfortably maintaining off-the-shoulder fashions according to another embodiment of the present disclosure.
Figure 17:
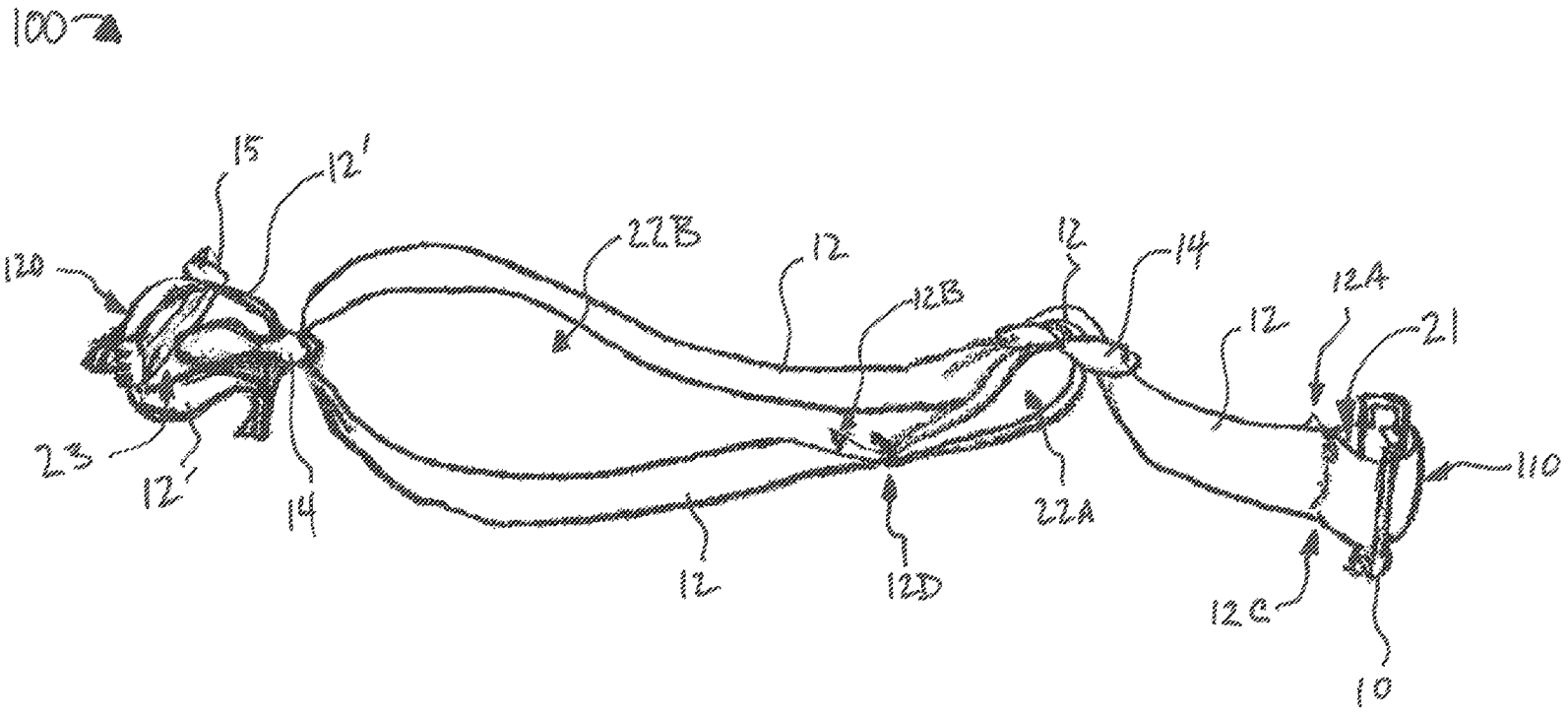
FIG. 17 shows a side perspective view of the embodiment shown in FIG. 16.

Another embodiment of a device 100 for comfortably maintaining off-the-shoulder fashions is shown representatively in FIGS. 16-17. In this embodiment, the band of material 12 is folded and one or more portions secured (e.g., temporarily secured and/or permanently secured) to form at least one loop. For example, as shown in FIG. 17, the band of material 12 may be configured to form four loops including: a first loop 21 formed by securing the first end 12A of the band of material 12 to a portion 12C of the band of material 12; a second loop 22A formed by securing the second end 12B of the band of material 12 to a second portion 12D of the band of material 12; a third loop 22B formed by securing the second loop 22A to a third portion 12E of the band of material 12; and a fourth loop 23 formed from a second band of material 12'.

The various loops 21,22A,22B,23, etc. . . . enable securement devices 10,15 and adjustment devices (e.g., tri-glide buckle 14) to be secured to the band of material 12 to achieve desired functions. For example, securement of at least one adjustment device (e.g., tri-glide buckle 14) along the band of material 12 enables the user to adjust the usable length L of the device 100 to accommodate fashions and users of different sizes and to adjust tension applied across the fashion garment by the device 100. Inclusion of at least two securement devices 10,15 along the band of material 12 enables the user to attach the first end 110 of the device 100 and the second end 120 of the device 100 to first and second attachment points A1,A2 of the garment (see, e.g., FIG. 8), respectively.

The band of material 12 may comprise any suitable material, such as cotton, elastic, silk, satin, nylon, rayon, polyester, denim, rubber, leather, pleather, or a combination of any two or more of the foregoing. In some embodiments, the band of material 12 comprises elastic. In some embodiments, the band of material 12 consists essentially of elastic. In some embodiments, the band of material 12 consists of elastic. Due to the envisioned placement of the device 100 near a major joint of the human body (e.g., the shoulder), the band of material 12 is formed of a material that stretches at least about 5% along its usable length L, for example at least about 5%, at least about 6%, at least about 7%, at least about 8%, at least about 9%, at least about 10%, at least about 11%, at least about 12%, at least about 13%, at least about 14%, at least about 15%, at least about 16%, at least about 17%, at least about 18%, at least about 19%, or at least about 20% along its usable length L. However, too much stretch along its usable length L will diminish, or even destroy, the intended functional benefit of the device 100. Accordingly, in some embodiments, the band of material 12 is formed of a material that stretches no more than about 50% along its usable length L, for example no more than about 50%, no more than about 45%, no more than about 40%, no more than about 35%, no more than about 30%, no more than about 25%, no more than about 20%, no more than about 15%, or no more than about 10% along its usable length L.

The first securement device 10 attaches the first end 110 of the device 100 to a first attachment point A1 of a garment G. The first securement device 10 may include, for example, a bar pin including a pin bar 10A that can be passed through the first attachment point A1 of the garment G to temporarily affix the first end 110 of the device 100 to the first attachment point A1 of the garment G. In other embodiments, the first securement device 10 may include a magnet, a snap, one half of a hook-and-loop type fastener (e.g., VELCRO), a button, or a button hole. In embodiments wherein the first securement device 10 includes a magnet, the first attachment point A1 of the garment G may include a magnet for magnetically mating with the magnet of the first securement device 10. In embodiments wherein the first securement device 10 includes a snap, the first attachment point A1 of the garment G may include a complementary snap receiver for physically mating with the snap of the first securement device 10. In embodiments wherein the first securement device 10 includes one half of a hook-and-loop fastener, the first attachment point A1 of the garment G may include the complementary half of the hook-and-loop fastener for physically mating with the first half of hook-and-loop fastener of the first securement device 10. In embodiments wherein the first securement device 10 includes a button, the first attachment point A1 of the garment G may include a button hole for physically mating with the button of the first securement device 10. In embodiments wherein the first securement device 10 includes a button hole, the first attachment point A1 of the garment G may include a button for physically mating with the button hole of the first securement device 10.

In some embodiments, such as shown in FIG. 17, the first securement device 10 is secured to the band of material 12 by a first loop 21 formed in the band of material 12. In such embodiments, the first end 12A of the band of material may be passed through the first securement device 10 (e.g., a bar pin) and secured to a first portion 12C of the band of material 12A, for example by stitches, heat seal, or any other secure fastening structure.

The second securement device 15 is slidably disposed on the third loop 22B by a second tri-glide buckle 14 and a fourth loop 23 formed by a second length of material 12'.

The second securement device 15 may include a bar pin component 15A and a Baretachment component 15B. The bar pin component 15A may include a pin 15D that can be opened or closed by a user and that can be inserted through the second attachment point A2 of the garment G to temporarily affix the second securement device 15 to the garment G. The bar pin component 15A may also include one or more attachment points 15H for securing the bar pin component 15A to the Baretachment component 15B. For example, the bar pin component 15A may include one or more holes 15H through which one or more anchors 15P of the Baretachment component 15B can be passed and secured, similar to the embodiment shown in FIG. 4. The bar pin component 15A may be formed of any suitable material, such as brass, nickel, steel, or sturdy resin (e.g., polycarbonate).

The Baretachment component 15B includes at least one window 15W through which the band of material 12 may pass, but which hinders the band of material 12 from twisting or folding over on itself along its long dimension. Thus, the window 15W preferably has inside dimensions slightly smaller than, about the same dimensions as, or slightly larger than the maximum dimensions of the band of material 12 (e.g., the lateral cross-sectional dimensions of the band of material 12 when it is in its unstretched state). In some embodiments, the window 15W has a height that is not more than about 200% of the thickness of the band of material 12 in its unstretched state, for example not more than about 200%, not more than about 175%, not more than about 150%, not more than about 125%, not more than about 100%, not more than about 95%, not more than about 90%, not more than about 85%, not more than about 80%, not more than about 75%, or not more than about 70% of the thickness of the band of material 12 in its unstretched state. The narrow passageway defined by the window 15W reduces or even eliminates the possibility that the band of material 12 will twist or fold on itself to create an uncomfortable contact between the band of material 12 and the user's skin.

The Baretachment component 15B also includes a base plate 15F that shields the user's skin from directly contacting the bar pin component 15A to prevent the bar pin component 15A from pinching, poking, scratching, chafing or digging into the user's skin.

The Baretachment component 15B also includes one or more attachment points 15P for securing the Baretachment component 15B to the bar pin component 15A. For example, as shown in FIG. 5, the Baretachment component 15B may include two posts 15P for mating with two holes 15H in the bar pin component 15A. To assemble the Baretachment component 15B, the posts 15P are passed through the holes 15H, and then the posts 15P are deformed to tightly secure the Baretachment component 15B to the bar pin component 15A. In some embodiments, the Baretachment component 15B is formed of a heat-deformable resin (e.g., polycarbonate, polyethylene, polypropylene, etc.) and the step of deforming the posts 15P comprises heating the posts 15P, applying pressure to the posts 15P to deform the posts 15P, and then cooling the posts 15P. In some embodiments, an adhesive secures the Baretachment device 15B to the bar pin 15A, in addition to or instead of posts 15P. In other embodiments, the second securement device 15, other than the pin 15D, is formed as a single unit, such as by additive manufacturing methods (e.g., 3D printing, injection molding, or metal casting) or subtractive manufacturing methods.

The second securement device 15 slidably disposed along the length of material 12' and near the second end 120 of the device 100. Similar to the arrangement shown in FIG. 6, the length of material 12' passes through the window 15W of the Baretachment component 15B and under the pin 15D of the bar pin component 15A.

In other embodiments, the second securement device 15 may include, for example, a bar pin including a pin bar 15A that can be passed through the second attachment point A2 of the garment G to temporarily affix the second end 120 of the device 100 to the second attachment point A2 of the garment G, wherein the second securement device 15 does not include a Baretachment component 15B. In other embodiments, the second securement device 15 may include a magnet, a snap, one half of a hook-and-loop type fastener (e.g., VELCRO), a button, or a button hole. In embodiments wherein the second securement device 15 includes a magnet, the second attachment point A2 of the garment G may include a magnet for magnetically mating with the magnet of the second securement device 15. In embodiments wherein the second securement device 15 includes a snap, the second attachment point A2 of the garment G may include a complementary snap receiver for physically mating with the snap of the second securement device 15. In embodiments wherein the second securement device 15 includes one half of a hook-and-loop fastener, the second attachment point A2 of the garment G may include the complementary half of the hook-and-loop fastener for physically mating with the first half of hook-and-loop fastener of the second securement device 15. In embodiments wherein the second securement device 15 includes a button, the second attachment point A2 of the garment G may include a button hole for physically mating with the button of the second securement device 15. In embodiments wherein the second securement device 15 includes a button hole, the second attachment point A2 of the garment G may include a button for physically mating with the button hole of the second securement device 15.

The tri-glide buckle 14 enables adjustment of the usable length L of the device 100. Similar to the arrangement shown in FIG. 2, the tri-glide buckle 14 is secured near the second end 12B of the band of material 12, for example by a second loop 22A through which a middle bar of the tri-glide buckle 14 passes. The band of material 12 passes under a first end bar 14A, over the portion of the band of material 12 that forms the second loop 22A and its associated middle bar 14B, and under a third bar 14C to form a slidably adjustable third loop 22B in the band of material 12 adjacent to the second loop 22A. The tri-glide buckle 14 may be formed of any suitable material such as metal or durable plastic.

Use of this embodiment of a device 100 for comfortably maintaining off-the-shoulder fashions is similar to use of the embodiment shown in FIGS. 1-10.

Figure 18:
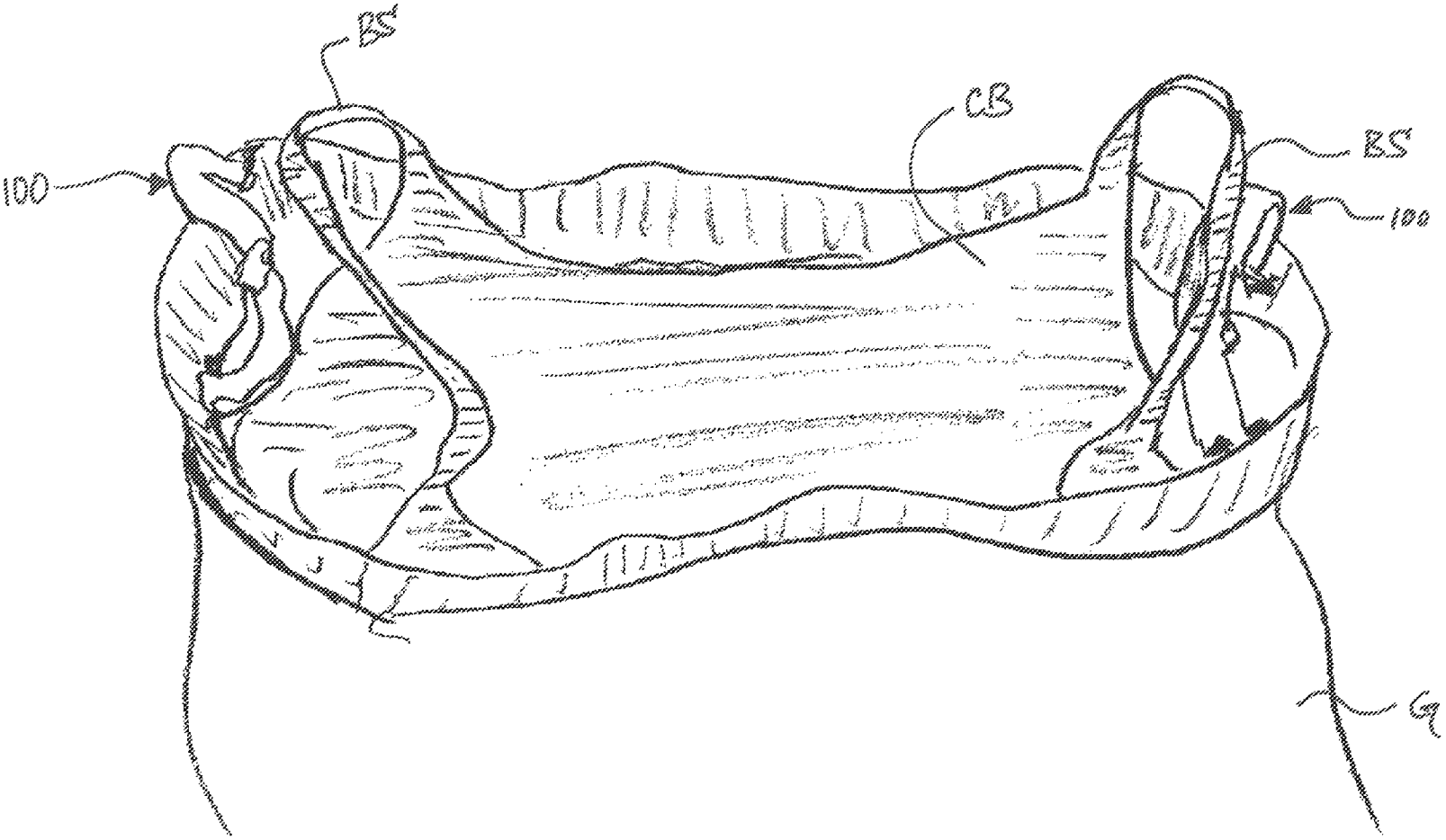
FIGS. 18-20 illustrate a method of comfortably maintaining off-the-shoulder fashions according to another embodiment of the present disclosure.
Figure 19:
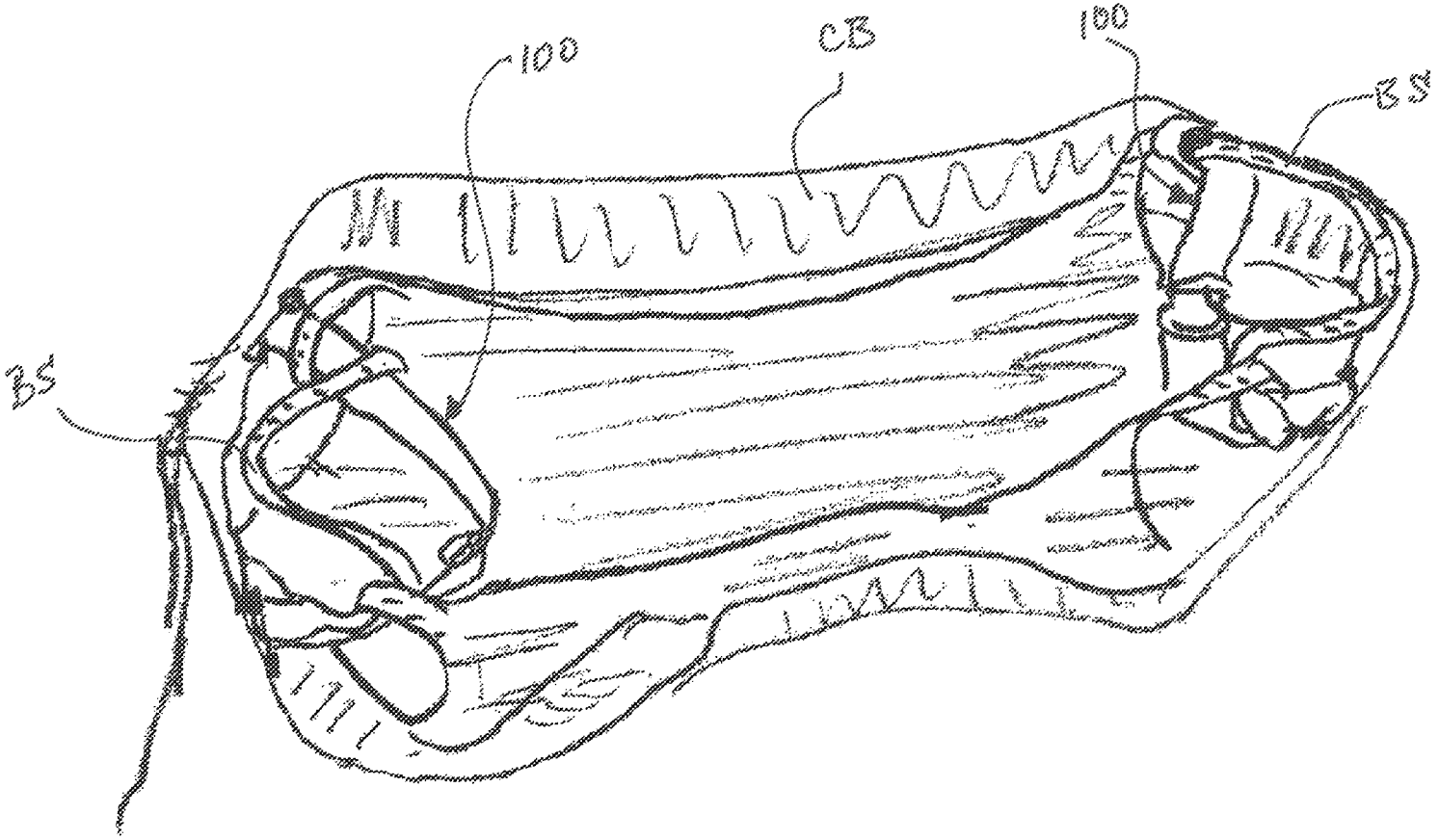
Figure 20:
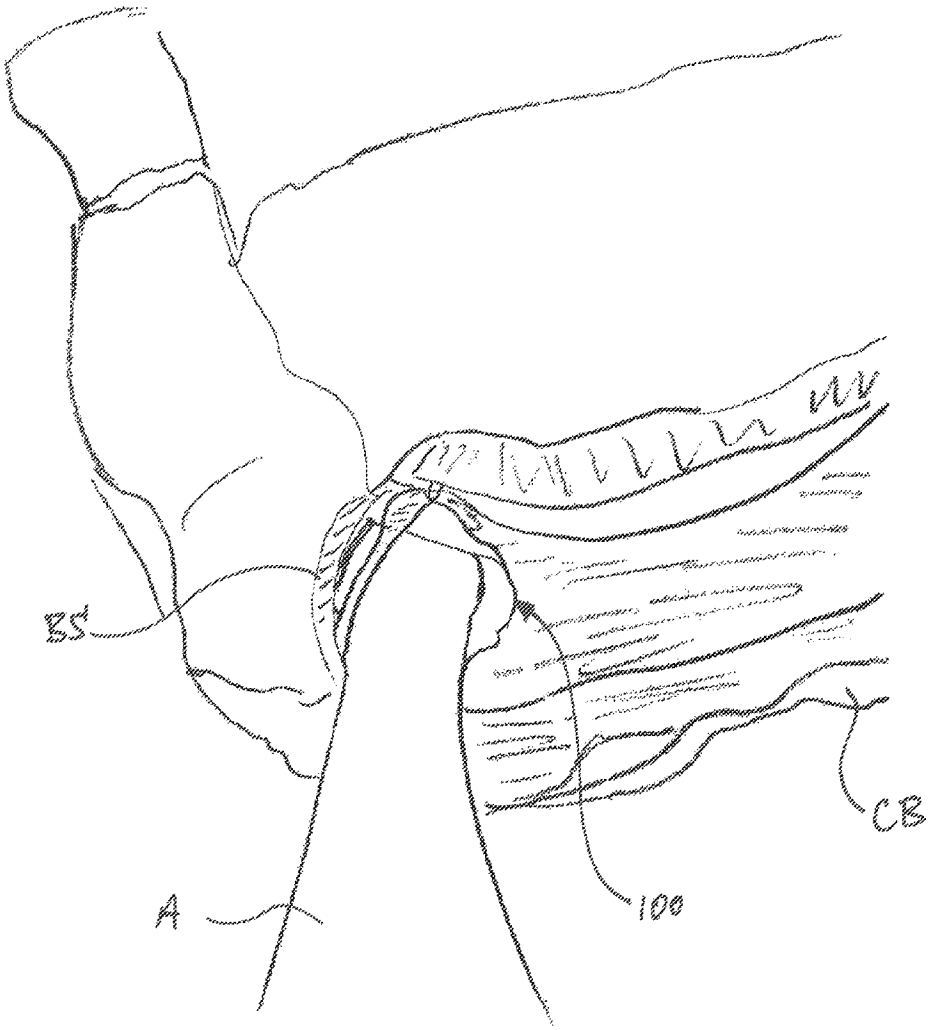

FIGS. 18-20 illustrate an alternative method of using a device 100 for comfortably maintaining off-the-shoulder fashions consistent with the present disclosure. In a first step, a device 100 consistent with the present disclosure is attached to a first attachment point A1 and to a second attachment point A2 of a garment G. Thereafter, a camisole strap or bra strap BS is wrapped around the device 100 one or more times, such as one time, two times, three times, four times, or more than four times, to form a passageway AP between the device 100 and the camisole strap or bra strap BS. The user then inserts his or her hand and arm A through the passageway AP to secure the off-the-shoulder garment G and the camisole or bra CB without exposing the camisole strap or bra strap BS.

In one embodiment, the present disclosure provides an adjustable positioning device 100 for comfortable maintenance of off the shoulder fashions, the device comprising: a band of material 12; a first securement device 10 disposed at a first end 110 of the band; a second securement device 15 including a baretachment component 15B mated with a bar pin component 15A, wherein the second securement device 15 is slidably disposed along a first loop 23 of the band 12 opposite the first end 110 of the band 12; and a tri-glide buckle 14 for enabling adjustment of usable length L of the device 100, wherein the tri-glide buckle 14 is disposed between the first end 110 of the band 12 and the first loop 23 of the band 12, wherein the baretachment component 15B includes a window gap 15W for slidably mating with the band of material 12 and for preventing the band of material 12 from rotating relative to the baretachment component 15B when the device 100 is in use under an arm A of a user. In some embodiments, the baretachment component 15B includes at least one post 15P for mating with at least one hole 15H of the bar pin component 15A. In some embodiments, the baretachment component 15B includes a base plate 15H for preventing the bar pin component 15A from directly contacting skin of the user. In some embodiments, the baretachment component comprises, consists essentially of, or consists of a polymer material. In some embodiments, the first securement device 10 includes a second bar pin.

In another embodiment, the present disclosure provides an off-the-shoulder garment G comprising a securing device 100 attached at a first end 110 to a first, posterior portion A1 of the garment G and further attached at a second end 120 of the securing device 100 to a second, anterior portion A2 of the garment G; and an arm hole defined at least in part by the securing device 100 and a segment of fabric of the garment G for covering at least a portion of an outer surface of an arm A of a user, wherein the securing device 100 is disposed below an axilla (e.g., armpit) of the user when the user wears the garment G. In some embodiments, the securing device 100 is attached at the first end 110 to the first, posterior portion A1 of the garment G by a first securement device 10. In some embodiments, the securing device 100 is attached at the second end 120 to the second, anterior portion A2 of the garment G by a second securement device 15. In some embodiments, the securing device 100 comprises a band of material 12, and wherein the first securement device 10 includes a baretachment component 15B for preventing the band of material 12 from rotating (e.g., twisting) relative to the first securement device 10. In some embodiments, the securing device 100 comprises a band of material 12, and wherein the second securement device 15 includes a baretachment component 15B for preventing the band of material 12 from rotating (e.g., twisting) relative to the second securement device 15.

What is claimed is:

1. An adjustable positioning device for comfortable maintenance of off the shoulder fashions, the device comprising:

a band of material;

a first securement device disposed at a first end of the band;

a second securement device including a baretachment component mated with a bar pin component, wherein the second securement device is slidably disposed along a first loop of the band opposite the first end of the band; and a tri-glide buckle for enabling adjustment of usable length of the device, wherein the tri-glide buckle is disposed between the first end of the band and the first loop of the band, wherein the baretachment component includes a window gap for slidably mating with the band of material and for preventing the band of material from rotating relative to baretachment component when the device is in use under an arm of a user.

2. The device of claim 1, wherein the baretachment component includes at least one post for mating with at least one hole of the bar pin component.

3. The device of claim 1, wherein the baretachment component includes a base plate for preventing the second bar pin component from directly contacting skin of the user.

4. The device of claim 1, wherein the baretachment component comprises, consists essentially of, or consists of a polymer material.

5. The device of claim 1, wherein the first securement device includes a bar pin.

* * * * *